US005257780A

United States Patent [19]

Cook et al.

[11] Patent Number: 5,257,780

[45] Date of Patent: Nov. 2, 1993

[54] FOOTBALL GAME APPARATUS

[75] Inventors: Marshall K. Cook, Glendale; Donald F. Collins, Chandler, both of Ariz.

[73] Assignee: National Sports Games, Inc., Phoenix, Ariz.

[21] Appl. No.: 831,091

[22] Filed: Feb. 10, 1992

Related U.S. Application Data

[63] Continuation of Ser. No. 698,930, May 13, 1991, abandoned.

[51] Int. Cl.[5] ..... A63B 67/00

[52] U.S. Cl. ..... 273/55 R; 273/1.5 A; 273/26 R; 273/382; 273/397; 273/402

[58] Field of Search ..... 273/1.5 R, 1.5 A, 26 R, 273/26 A, 382, 389, 394–397, 402, 185 R, 371, 29 A, 55 R

[56] References Cited

U.S. PATENT DOCUMENTS

| | | | |
|---|---|---|---|
| 1,574,201 | 2/1926 | Lynch | 273/397 |
| 2,145,220 | 1/1939 | Cupstid | 273/395 |
| 2,806,701 | 9/1957 | Durant | 273/395 |
| 3,252,705 | 5/1966 | Cornberg | 273/371 |
| 3,652,089 | 3/1972 | O'Connor | 273/395 |
| 4,013,292 | 3/1977 | Cohen et al. | 273/371 |
| 4,215,867 | 8/1980 | Natwick | 273/397 |
| 4,805,917 | 2/1989 | Cochran et al. | 273/397 |
| 4,826,166 | 5/1989 | Baker et al. | 273/402 |
| 4,838,549 | 6/1989 | Woodall | 273/1.5 A |
| 4,858,922 | 8/1989 | Santavaci | 273/26 R |
| 4,927,160 | 5/1990 | Nichol et al. | 273/382 |

*Primary Examiner*—William H. Grieb
*Assistant Examiner*—Steven B. Wong
*Attorney, Agent, or Firm*—Cahill, Sutton & Thomas

[57] ABSTRACT

Balls thrown at a target are returned to a player by a combination of a moving belt and an inclined delivery surface. The belt is out of reach of the player and, when stopped, collects the balls on its upper surface, stopping the game. A timer controls movement of the belt. Sensors positioned to detect movement of a ball toward the target and through openings in the target send signals to a sign, causing the sign to present different visual displays regarding progress of the game.

7 Claims, 1 Drawing Sheet

FOOTBALL GAME APPARATUS

This application is a continuation of application Ser. No. 07/698,930, filed May 13, 1991 now abandoned.

TECHNICAL FIELD

This invention involves apparatus for simulating the passing aspects of a football game.

BACKGROUND ART

Others have devised a variety of ball throwing games in the past. For example, U.S. Pat. No. 2,145,220, granted Jan. 24, 1939, to D. C. Cupstid for "Game Apparatus" discloses a baseball throwing game in which balls thrown at a target are returned to the player by a motorized conveyor belt. The game apparatus disclosed is not automated and scoring is manual.

A more sophisticated ball game is disclosed in U.S. Pat. No. 4,013,292, granted Mar. 22, 1977, to M. Cohen, et. al. for "Automatic Basketball Game Having Scoring Indicator and Time Limitation". This game is automated for scoring and timing and for controlling the number of basketballs made available to a player for each game. A gravity ball return system is employed with a solenoid-actuated plunger controlling dispensing of balls. The balls which have not been dispensed are kept out of reach of the player.

Neither the Cupstid apparatus nor the Cohen, et. al. apparatus lends itself to handling the ovoid shaped football or the more complex rules governing progress of the passing aspects of a football game.

DISCLOSURE OF THE INVENTION

The apparatus of this invention includes a target with at least one, and preferable two, openings therein through which a player attempts to throw a football. If more than one opening is employed, they are of different sizes requiring different degrees of throwing skill of the player. Movement of a ball toward and through the target is detected by sensors which send signals to a sign presenting a visual display of the players success or failure in throwing balls at the target. A combination moving belt and inclined surface return thrown balls to the player. The belt terminates out of reach of the player and the game ends when a timer stops motion of the belt, thereby trapping the ball or balls out of reach of the player.

BRIEF DESCRIPTION OF THE DRAWINGS

The invention is described in greater detail hereinafter by reference to the accompanying drawings, wherein.

BEST MODE FOR CARRYING OUT THE INVENTION

Figure 1:
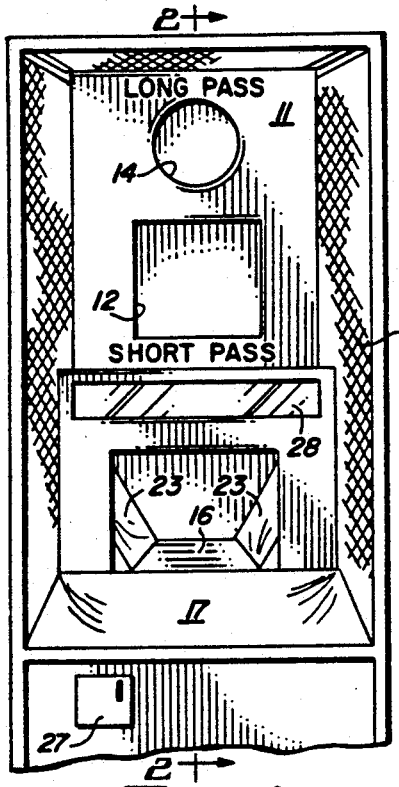
FIG. 1 is a partial front elevational view of game apparatus of the invention.
Figure 3:
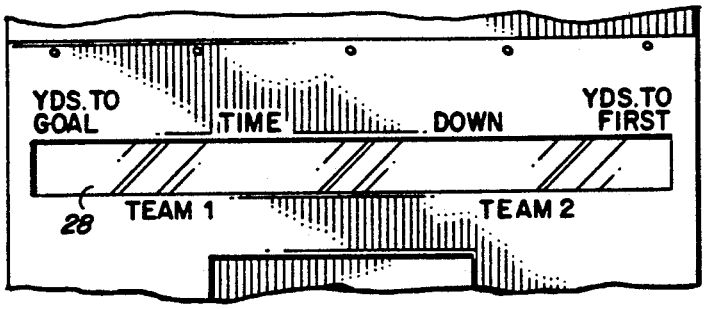
FIG. 3 is an enlarged elevational view of a sign forming part of the apparatus.
Figure 2:
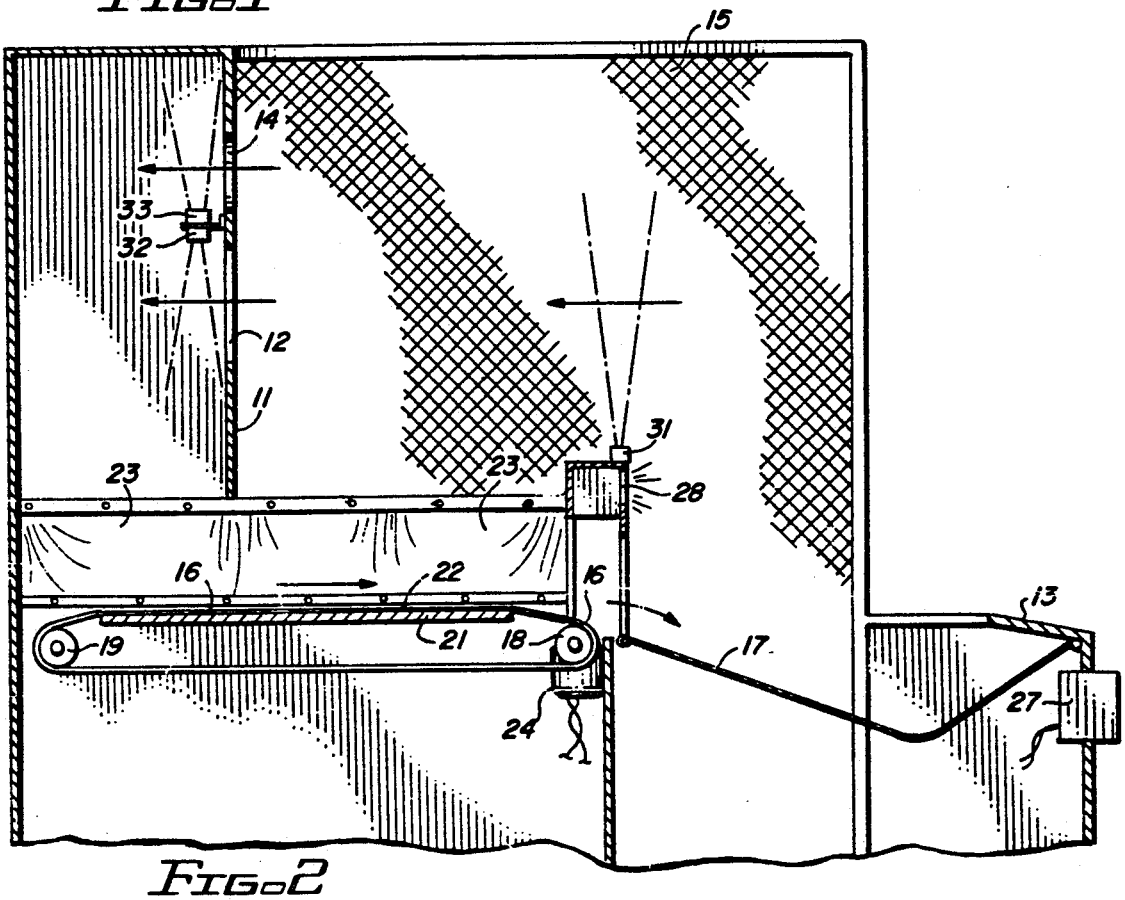
FIG. 2 is a vertical sectional view through the apparatus, taken as indicated by line 2—2 in FIG. 1.

The game apparatus shown in FIGS. 1 and 2 includes a target 11 having at least one target opening 12 therein through which a player standing in position before a counter 13 at the front of the apparatus attempts to throw a football. There is a distance of several feet, say ten feet, between the player position and the target 11. This distance can, of course, be greater than that to require greater player skill, but when the game apparatus is used indoors, space limitations usually dictate the permissible overall size of the apparatus.

The target 11 also preferably includes at least one additional opening 14 therein of a different size than opening 12. If opening 14 is smaller than opening 12, as shown in FIG. 1, throwing a ball through opening 14 requires greater skill than throwing a ball through opening 12. In accordance with this invention, a ball thrown through small target opening 14 is credited as a "long pass", say 10–24 yards, while a ball thrown through large target opening 12 is credited as a "short pass", say 1–9 yards.

To confine poorly thrown balls, a cage 15 extends over the top and sides of the apparatus. That portion of cage 15 forward of target 11 is preferably made of open screen or other substantially transparent material to permit spectators to view the game in progress. Balls thrown at and through target 11 are returned to a player during the course of the game by the combination of a moving conveyor belt 16 and an inclined surface of a belly curtain 17.

Belt 16 is of the endless variety, passing over front and rear rollers 18 and 19 and having a generally horizontal upper run over a belt support board 21. The upper surface 22 of belt 16 is adapted to receive balls thrown at target 11 and has a length sufficient to extend from behind to in front of the target so as to catch balls which pass through openings 12 and 14 as well as balls which strike the target but do not pass through either of these openings.

Belt 16 preferably has a width which is less than the width of the apparatus but slightly in excess of the longest dimension of the football used in the game. Sloping ball return curtains 23 disposed to either side of the belt direct balls onto the belt. The combination of moving conveyor belt 16 and ball return curtains 23 has been determined to be a particularly effective system for transporting ovoid shaped balls to a central region of the belly curtain 17 where they are readily accessible to the player.

Figure 4:
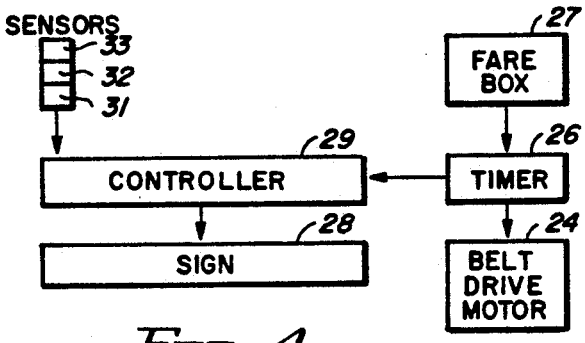
FIG. 4 is a block diagram, schematically illustrating the control system for the apparatus.

Belt 16 is preferably driven, or propelled, by an electric motor 24 associated with front roller 18 (see FIG. 2). When the apparatus of this invention is used in a game in which a player is allotted a specific period of time in which to attempt to throw balls through the target openings 12 or 14, a timer 26 is interposed between a fare box 27 which starts the game and the belt drive motor 24. (See schematic FIG. 4). When the allotted time has expired, timer 26 interrupts electrical current to drive motor 24, stopping movement of the belt 16. Thereafter, a ball or balls thrown at the target 11 come to rest on the upper surface 22 of the stationary belt 16. It is to be noted that the forward end of belt 16 as it wraps around the front roller 18 is spaced sufficiently far away from the player position at counter 13 to be out of reach of the player. This effectively stops game play until money is inserted into the fare box 27 to start a new game and, incidentally, to energize motor 24 to drive conveyor belt 16 to deliver a ball or balls to the player.

Game playing with the apparatus of this invention is more interesting if the apparatus includes several footballs, say as many a five or six. This insures that one or more balls are always available in the belly curtain 17 throughout the game so the player can throw balls as quickly as he can without having to wait for a ball to be returned by conveyor belt 16.

A player is apprised of the progress of the game by means of an electric sign 28 which is capable of presenting a variety of visual displays under the control of a controller 29. Sign 28 is of the moving message type capable of indicating information such as "yards to go", "time", "down", "yards to first", and the scores of one or two players. The sign may also display messages interacting with the players by asking questions and encouraging play. The sign 28 is positioned within the apparatus at a location conveniently within the view of a player when throwing balls at the target 11 (see FIGS. 1 and 2).

Sign controller 29 processes information obtained from timer 26 and a trio of motion sensors 31, 32 and 33. The first motion sensor 31 is located ahead of target 11 and detects movement of a ball toward the target. Motion detectors 32 and 33 are positioned behind the target 11. Detector 32 has its field of view, so to speak, across target opening 12 and detects movement of a ball through that opening. Detector 33 has its field of view across target opening 14 and detects movement of a ball through that opening.

When detectors 31 and 32 sequentially detect ball movement, they signal the sign controller 29 which recognizes these signals as a completion of a "short pass" and directs sign 28 to make an appropriate change in the message appearing in its display. When detectors 31 and 33 sequentially detect ball movement, they signal the sign controller 29 which recognizes these signals as completion of a "long pass", and directs sign 28 to make an appropriate change in the message on its display. When sign controller 29 receives a signal from detector 31 that is not followed by a signal from either detector 32 or 33, the controller recognizes this as an "incomplete pass" and instructs sign 28 accordingly.

Play continues with one or more players throwing balls at the target 11 until timer 26 terminates the game. Controller 29 may be programmed to instruct sign 28 to continue for a set period to display the game status as of the time play was stopped. Thereafter, the controller 29 may instruct the sign 28 to display one or more messages to induce others to play the game.

From the foregoing, it should be apparent that this invention provides improved game apparatus particularly suited to simulate the passing aspects of a football game.

What is claimed is:

1. A football game apparatus comprising a target, a player position spaced from said target, a football, said target having an opening therein through which a player attempts to throw a football, a movable conveyor belt disposed beneath said target and having a surface onto which the football falls upon being thrown toward said target and upon being thrown through said opening in said target, means for propelling said belt so that said surface thereof moves toward the player, said belt terminating at a distance from the player greater than the reach of the player, an inclined delivery surface between said belt and said player position in front of and within reach of the player, said delivery surface being of a size sufficient to hold at least two footballs within the reach of the player, means positioned between the player position and the target for detecting movement of all footballs thrown towards said target and means for detecting movement of a football through said opening in the target.

2. The game apparatus of claim 1, further characterized in that said target has at least two openings therein through which the player attempts to throw a ball, said target openings being of different sizes representing different degrees of difficulty for the ball throwing ability of the player, and further comprises means for detecting movement of a football through each of the openings in said target.

3. The game apparatus of claim 2, further comprising a sign capable of presenting a variety of visual displays, and means for causing said sign to present a different visual display when said detecting means detects movement of a ball through one of said target openings than when the detecting means detects movement of a ball through another of said target openings.

4. The game apparatus of claim 3, further comprising timer means for controlling the operation of said propelling means.

5. The game apparatus of claim 1, further comprising timer means for controlling the operation of said propelling means.

6. The game apparatus of claim 1, further comprising a sign capable of presenting a visual display and means for causing said sign to change the visual display when said detecting means detects movement of a football through said opening in the target.

7. The game apparatus of claim 6, further comprising timer means for controlling operation of said propelling means.

* * * * *